US005123646A

United States Patent [19]

Overby et al.

[11] Patent Number: 5,123,646

[45] Date of Patent: Jun. 23, 1992

[54] APPARATUS AND METHOD FOR REMOVING GRIPS

[76] Inventors: Bill Overby, 2403 S. Brentwood, Springfield, Mo. 65804; Charles M. Tagami, 442 S. Prince La., Springfield, Mo. 65802

[21] Appl. No.: 687,834

[22] Filed: Apr. 19, 1991

[51] Int. Cl.[5] ..... A63B 53/14

[52] U.S. Cl. ..... 273/81.2; 273/81 R; 16/111 R

[58] Field of Search ..... 273/81 R, 165, 81.2, 273/67 DA, 75; 16/111 R; 401/97

[56] References Cited

U.S. PATENT DOCUMENTS

| | | | |
|---|---|---|---|
| 1,756,953 | 5/1930 | O'Sullivan | 401/97 |
| 1,781,290 | 11/1930 | Margrave | 273/75 |
| 2,646,879 | 7/1953 | Carstensen | 401/97 |
| 2,672,342 | 3/1954 | Griffin | 273/75 |
| 2,876,010 | 3/1959 | Hugman | 273/81.2 |
| 3,606,325 | 9/1971 | Lamkin et al. | 273/81.5 |
| 4,819,939 | 4/1989 | Kobayashi | 273/81 R |
| 4,878,667 | 11/1989 | Tosti | 273/81.2 |

*Primary Examiner*—Benjamin Layno
*Assistant Examiner*—Steven B. Wong
*Attorney, Agent, or Firm*—Michael Yakimo, Jr.

[57] ABSTRACT

Apparatus for facilitating the removal of a grip from a handle, such as a golf club, comprises a double side tape wrapped about the handle with a cutting wire embedded therein. Adhesive is placed about the tape with the grip placed thereon. For removal one end of the cutting wire is grasped by a user and pulled along the length of the handle to sever the overlying grip. An alternative embodiment embeds the cutting wire in the grip proper for subsequent manipulation and grip severance.

24 Claims, 2 Drawing Sheets

APPARATUS AND METHOD FOR REMOVING GRIPS

BACKGROUND OF THE INVENTION

This invention pertains to grips, such as a golf club grip, and more particularly to apparatus and a method for facilitating the removal of a grip from its associated handle.

Hand grips are used in a variety of applications such as tools and sporting goods. The use of grips, particularly in the sporting goods field such as a golf grip, presents problems during the removal process. In the past the grip is usually removed by scoring the grip proper with a knife blade, razor blade or other cutting utensil. If penetration is too deep the cutting tool may score the underlying handle and/or shaft. In connection with graphite-type of handles, such as a golf club shaft or the like, this scoring may lead to a subsequent, undesirable fracture of the shaft during use. Such a fracture necessarily leads to an expensive replacement of the golf club or the like.

In response thereto we have invented a cutting tool for facilitating the removal of a used grip from a handle such as a golf club or the like. In our first embodiment we utilize a double-sided tape having a cutting wire longitudinally extending therethrough. The tape is positioned about the handle/shaft to serve as a base for the overlying grip with the wire extending along the length of the underlying handle/shaft. Upon fixation of the grip atop the tape with a conventional adhesive, at least one end of the wire projects beyond the affixed grip. For removing the grip this wire is grasped by the user and pulled along the length of the shaft. This action causes the wire to sever the overlying grip which facilitates the removal of the grip from the handle/shaft without the need for exterior cutting of the grip and possible scoring of the underlying handle/shaft.

In the second embodiment of our invention the cutting wire is embedded in the grip and longitudinally extends along the length of the grip. An end of the wire is made available for subsequent user manipulation at the time of a desired grip removal. Such manipulation causes the wire to sever the grip and facilitate removal of the grip from the underlying handle/shaft.

It is therefore a general object of the invention to provide apparatus for facilitating the removal of a grip from an underlying handle.

Another object of this invention is to provide a grip structure which includes an associated cutting tool to sever the grip.

A still further object of this invention is to provide a grip structure, as aforesaid, in which the grip is severed from the interior surface thereof.

Another particular object of this invention is to provide apparatus, as aforesaid, which precludes the need to score the exterior surface of the grip for removal.

Still another important object of this invention is to provide a grip, as aforesaid, which has the cutting tool embedded in the grip structure.

A still further object of this invention is to provide an underlying base for said grip structure which incorporates said cutting tool in the form of an elongated cutting wire embedded therein.

Still another further object of this invention is to provide a method of affixing a grip to a handle which provides for an easy subsequent separation of said grip from said handle.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figures 1, 2, 3, 4, 5, 6:
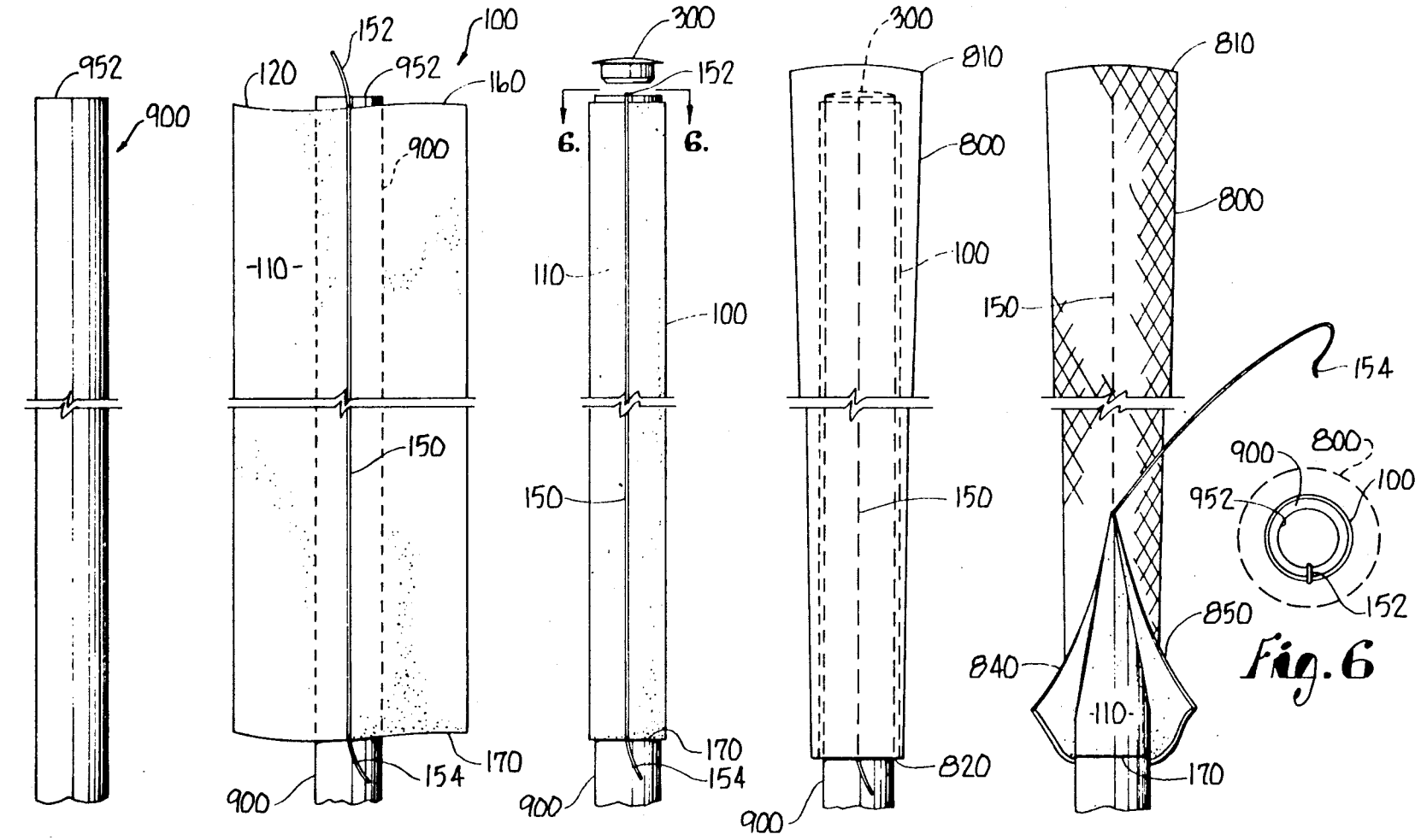
FIG. 1 is a fragmentary view of one end of a golf club shaft, the shaft end being foreshortened for purposes of illustration.
FIG. 2 is a view, as in FIG. 1, illustrating a first embodiment of the invention, i.e. a cutting wire tape, prior to placement about the shaft.
FIG. 3 is a view, as in FIGS. 1 and 2, illustrating the placement of the cutting wire tape about the shaft with a cap/plug being exploded from its nested position within the proximal end of the shaft.
FIG. 4 is a view of the shaft, as in FIGS. 1-3, illustrating a grip positioned about the tape.
FIG. 5 is a view of the shaft, as in FIG. 4, illustrating the severing action of the cutting wire along the grip proper.
FIG. 6 is a view, taken along lines 6—6 in FIG. 3, illustrating the relationship among the shaft, tape, cutting wire and grip.
Figures 7, 8, 9:
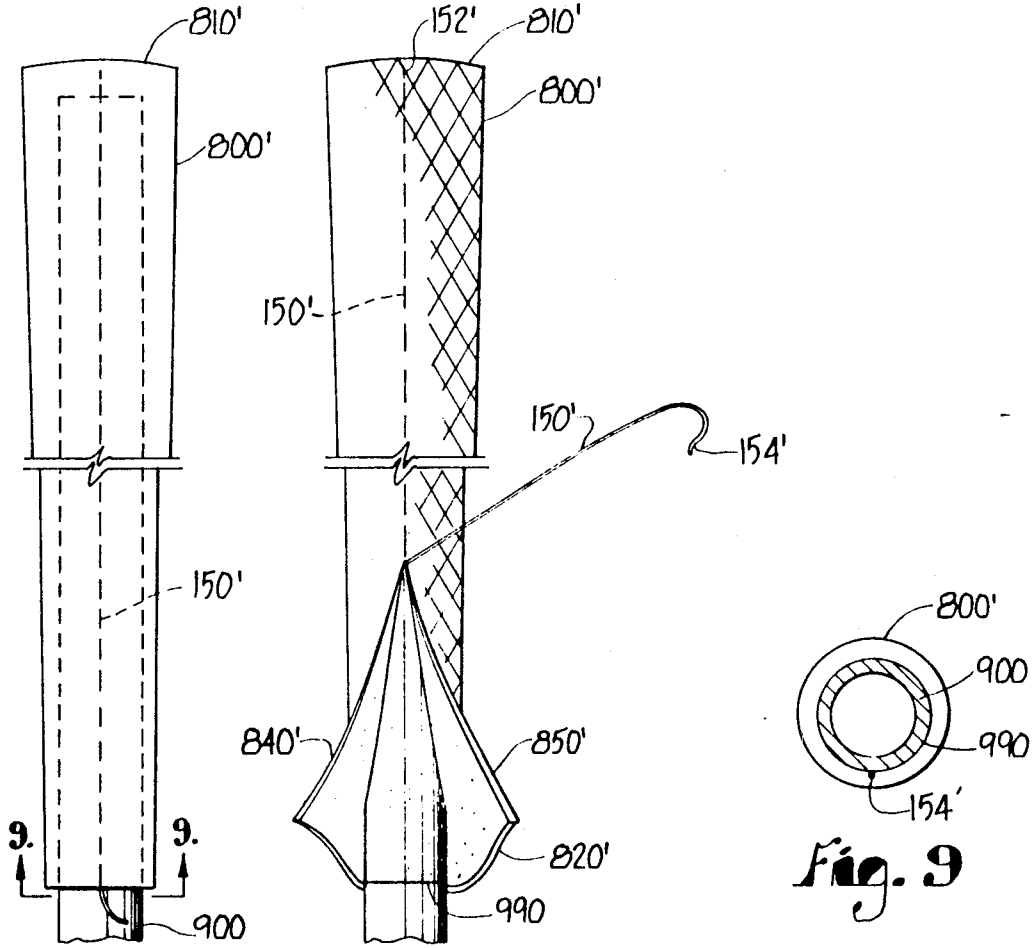
FIG. 7 is a view, as in FIG. 1, illustrating a second embodiment of the invention, i.e. a cutting wire embedded in a grip on the shaft.
FIG. 8 is a view illustrating the severing action of the cutting wire along the extent of the grip.
FIG. 9 is a view, taken along lines 9—9 in FIG. 7, illustrating the relationship among the shaft, grip and cutting wire.

Turning more particularly to the drawings, FIGS. 1-6 illustrate a first embodiment 100 of the invention in use with a grip 800 on a golf club shaft 900. Therein is shown a tape 100 having first and second adhesive-laden surfaces 110, 120. A cutting wire 150 is embedded within the tape 100 or otherwise associated with the tape 100 by adhesive or the like. The wire 150 extends along the length of the tape between the proximal 160 and distal 170 ends of the tape 100. The width of the tape is such that it encompasses the diameter of the shaft 900 of the golf club as fragmentarily shown in FIG. 1. As shown in FIG. 2 the tape 100 is positioned so that a multi-strand wire 150 runs along the extent of the shaft 900. Once wrapped, as shown in FIG. 3, the tape 150 serves as a base for the overlying grip 800 as well as an anchor for the cutting wire 150. The cutting wire 150 preferably extends beyond the proximal 160 and/or distal 170 ends and presents a proximal wire end 152 and/or a distal wire end 154. The proximal end 152 of the wire may be tucked into the free proximal end 952 of the shaft 900 and held in place thereat by a cap/plug 300 nesting therein. Alternatively, the distal end 154 of the wire 150 may extend beyond the distal end 170 of the tape 100 as shown in FIGS. 3 and 4. A tab (not shown) or the like may be attached to this distal wire end 154 for subsequent grasping/purchase by the user.

Subsequent to affixing the tape 100 about the shaft 900, the grip 800 is ready to be positioned about the shaft 900. An adhesive is placed about the tape 100. The grip 800 is then positioned about shaft 900 as shown in FIG. 4. Once the adhesive sets the grip 800 is affixed to the shaft 900 for subsequent use.

During subsequent golf club use, wear and tear will require replacement of the grip 800 with a new grip. The proximal end 810 of the grip 800 which extends beyond the shaft 900 may be removed so as to expose the cap 300. Cap 300 removal will expose the proximal end 152 of the wire for gripping/purchase by the user. Alternatively, the distal wire end 154 of the cutting wire may be grasped/purchased by the user. Subsequent to said grip/purchase of a wire end 152 or 154 the user pulls the wire end along the length of the golf shaft 900 towards the opposed end either from the proximal end 810 to distal end 820 or vice versa. As shown in FIG. 5 the distal end 154 of cutting wire 150 has been selected by the user and pulled along shaft 900 towards the proximal end 810 of grip 800. This action causes the wire 150 to be pulled from its anchored tape 100 position so as to sever the overlying grip 800 into flaps 840, 850. Continuing the wire 150 movement along the length of shaft 900 will sever the grip 800 into folds 840, 850 entirely extending along its length so as to facilitate the removal of the grip 800 from the underlying golf shaft 900 or the like. Depending on the relative position of the wire 150 within tape 100, the underlying tape 800 may also be severed.

Accordingly, it can be seen that the above structure precludes the need to score the exterior surface of grip 800 along the length of the underlying shaft 900 so as to facilitate grip 800 removal. Such preclusion eliminates the need to use an exterior cutting device and the possible undesirable scoring of the underlying shaft 900 and fracture thereof as discussed above.

A second embodiment of our invention is as shown in FIGS. 6-9. Therein is shown the use of the cutting wire 150' embedded or otherwise affixed to the grip 800' along the length thereof. Again the wire 150' presents proximal 152' and distal 154' ends. The grip 800' is affixed to the shaft 900 in a conventional manner which normally comprises pouring an adhesive over the end of the shaft as covered by a tape 990 and then positioning the grip 800' thereon. Once the adhesive sets the grip 800' is firmly affixed to the shaft 900.

When replacement is desired the user again grips or otherwise obtains a purchase on an end 152' or 154' of grip 800' as above described. The wire end 152' or 154' is pulled along the length of grip 800' towards its opposite end. Again this action severs the grip 800' into flaps 840', 850' to facilitate grip 800' removal from the underlying shaft 900. Thus, no exterior scoring of the grip 800' positioned above shaft 900 is required.

It can also be seen that alternatively the wire 150 may be laid in the adhesive before placing the grip 800 thereon. As such, the wire 150 will be positioned between the tape 100 and grip 800 upon setting of the adhesive. Upon grip 800 removal the wire 150 is pulled along the length of the shaft 900 as above described. Again the wire 150 action severs the grip 800 from the interior surface thereof so as to facilitate grip removal.

Accordingly, our disclosure will lead to many variations of the inventive concept in our invention including various new methods of applying grips to handles in connection with a cutting tool so as to facilitate subsequent grip removal. Such methods include extending the cutting wire 150 along the shaft 900 and between the shaft 900 and grip 800. This relative position allows the grip 800 to be subsequently severed from the interior thereof by grasping a wire 150 end and manipulating the wire 150 along the shaft 900 encompassed by the overlying grip 800.

Although certain embodiments of this invention have been described and illustrated herein it is understood that the scope of our invention need not be restricted thereto except as set forth in the following claims and allowable functional equivalents thereof.

Having thus described the invention, what is claimed as new and desired to be secured by Letters Patent is:

1. A device for use in the removal of a grip on a handle of a shaft, the device comprising:
   a cutting tool;
   means associating said tool with the grip;
   a user-operable end on said tool, whereupon manipulation of said end causes said tool to sever the grip to facilitate removal of the grip from the handle;
   means for maintaining said user-operable end of said tool adjacent the handle during use, said means precluding interference of said tool end with the use of the grip, said tool end removable by a user from said maintaining means prior to said manipulation.

2. The device as claimed in claim 1 wherein said tool comprises an enlongated wire.

3. The device as claimed in claim 2 wherein said associating means comprises:
   a tape for placement about the handle and below said grip, said wire attached to said tape;
   said wire having an end positioned within said maintaining means and presenting said user-operable end, whereupon said manipulation severs said overlying grip.

4. The device as claimed in claim 3 wherein said end of said wire extends beyond said tape to present an initial zone of purchase to said user, said initial zone of purchase within the maintaining means.

5. The device as claimed in claim 3 wherein said wire extends along the length of said tape, whereby to sever the grip along the length thereof.

6. The device as claimed in claim 3 wherein said maintaining means comprising a cap placed adjacent the end of the shaft, said cap maintaining said wire end therein.

7. The device as claimed in claim 2 wherein said associating means is presented by embedding said wire in the grip with an end of said wire presenting said user-operable end, said maintaining means presented by said embedding of said wire end within the grip.

8. The device as claimed in claim 7 wherein said wire extends along the length of the grip, whereby to sever the grip along the length thereof.

9. The device as claimed in claim 7 wherein said user-operable end of said wire extends beyond the grip upon release from said maintaining means to present an initial zone of purchase to said user.

10. The device as claimed in claim 7 wherein said maintaining means comprises a cap placed adjacent the free proximal end of the shaft, said cap maintaining said user-operable end of said wire.

11. The device as claimed in claim 1 wherein said maintaining means comprises a cap placed adjacent a proximal end of the handle, said cap maintaining said tool end to a position adjacent the handle end.

12. A device for use in the removal of a grip on a handle of a shaft, the device comprising:
   a cutting tool;
   means for positioning said tool between and exterior surface of the grip and the handle;

means for presenting a zone of purchase of said tool to a user;

means for maintaining said zone of purchase adjacent the handle during use, said zone of purchase removable by the user from said maintaining means prior to a desired grip removal, whereupon movement of said purchased tool along the handle severs the grip.

13. The device as claimed in claim 12 wherein said positioning means comprises:

a tape for placement about the handle and below the grip, said tool attached to said tape;

said tool having an end presenting said zone of purchase.

14. The device as claimed in claim 13 wherein said end of said tool extends beyond said tape and into said maintaining means.

15. The device as claimed in claim 13 wherein said tool extends along the length of said tape, whereby to sever the grip along the length thereof.

16. The device as claimed in claim 13 wherein said maintaining means comprises a cap placed adjacent the free proximal end of the shaft, said cap confining said user-operable end of the tool within the shaft.

17. The device as claimed in claim 12 wherein said positioning means is presented by embedding said tool in the grip within an end of said tool presenting said zone of purchase.

18. The device as claimed in claim 17 wherein said tool extends along the length of the grip, whereby to sever the grip along the length thereof.

19. The device as claimed in claim 17 wherein said end of said tool extends beyond the grip to present said initial zone of purchase to the user, said zone of purchase extending into said maintaining means.

20. A method of applying a grip to a handle to facilitate a subsequent removal comprising the steps of:

selecting a zone on said handle for said grip;

applying an adhesive along said zone;

extending a cutting tool along said zone with an end of said cutting tool extending beyond said zone;

positioning said grip about said zone and overlying said cutting tool, said adhesive affixing said grip to said handle;

maintaining said end of said cutting tool extending beyond said zone adjacent the handle to preclude interference with use of the grip;

releasing said maintained end of said cutting tool, whereupon manipulation of said released cutting tool end along said zone severs said grip to facilitate said removal.

21. A device for use with a grip on a handle of a golf club shaft, the shaft having an aperture at a free end proximal to a user, the device comprising:

an elongated wire presenting a user-operable end;

a tape for placement about the shaft and below the grip, said wire attached to said tape;

the aperture at the free proximal end of the shaft receiving the user-operable end therein to preclude interference of the user-operable end with the grip during use of the shaft, whereupon a manipulation of said user-operable end of the wire released from the aperture severs the grip to facilitate removal of the grip from the shaft.

22. A device for use with a grip on a handle of a golf club shaft the shaft having an aperture at a free end proximal to a user, the device comprising:

an elongated wire presenting a user-operable end, said wire embedded in the grip;

the aperture at the free proximal end of the shaft receiving the user-operable end therein to preclude interference of the user-operable end with the grip during use of the shaft, whereupon a manipulation of said user-operable end of the wire released from the aperture severs the grip to facilitate removal of the grip from the shaft.

23. A device for use with a grip on a handle of a golf club shaft the shaft having an aperture at a free end proximal to a user, the device comprising:

a cutting tool;

a tape for placement about the shaft and beneath the grip, said tool attached to said tape;

said tool having an end presenting a zone of purchase to a user;

the aperture in the end of the shaft allowing for insertion of said zone of purchase therein to preclude interference with the grip during use of the handle, whereupon movement of said zone of purchase, released from the aperture, by the user along the handle severs the grip.

24. a device for use with a grip on a handle of a golf club shaft the shaft having an aperture at a free end proximal to a user, the device comprising:

a cutting tool;

said tool embedded in the grip;

said tool having an end presenting a zone of purchase to a user;

the aperture in the end of the shaft allowing for insertion of said zone of purchase therein to preclude interference with the grip during use of the handle, whereupon movement of said zone of purchase, released from the aperture, by the user along the shaft severs the grip.

* * * * *

UNITED STATES PATENT AND TRADEMARK OFFICE

CERTIFICATE OF CORRECTION

PATENT NO. : 5,123,646

DATED : JUNE 23, 1992

INVENTOR(S) : BILL OVERBY and CHARLES M. TAGAMI

It is certified that error appears in the above—identified patent and that said Letters Patent is hereby corrected as shown below:

Column 4, line 27, delete "said" and substitute --the--.

Column 4, line 31, delete "said" and substitute --the--.

Column 4, line 35, delete "said" and substitute --the--.

Column 4, line 36, delete "the" and substitute --said--.

Column 4, line 41, delete "comprising" and substitute --comprises--.

Column 4, line 67, delete "and" and substitue --an--.

Column 5, line 28, delete "within" and substitute --with--.

Column 6, line 40, delete "a device" and substitute --A device--.

Signed and Sealed this

Fourteenth Day of September, 1993

Bruce Lehman

*Attest:*

BRUCE LEHMAN

*Attesting Officer*

*Commissioner of Patents and Trademarks*